US007033453B2

(12) United States Patent
Garvey et al.

(10) Patent No.: US 7,033,453 B2
(45) Date of Patent: Apr. 25, 2006

(54) METHOD FOR CHANGING THE ORIENTATION OF THE PLIES WITHIN A MULTI-PLY PRODUCT

(75) Inventors: Lee Patrick Garvey, Kaukauna, WI (US); Marc David Couture, Appleton, WI (US); Andy D. Kleist, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 230 days.

(21) Appl. No.: 10/719,638

(22) Filed: Nov. 21, 2003

(65) Prior Publication Data

US 2005/0109448 A1 May 26, 2005

(51) Int. Cl.
*B32B 37/00* (2006.01)

(52) U.S. Cl. ..... 156/152; 156/247; 156/249; 156/277; 156/278; 264/550

(58) Field of Classification Search ..... 156/278, 156/152, 247, 249; 264/550; 242/550
See application file for complete search history.

(56) References Cited

U.S. PATENT DOCUMENTS

| | | | | |
|---|---|---|---|---|
| 1,974,594 | A * | 9/1934 | Angier | 156/324 |
| 3,905,864 | A | 9/1975 | Curry et al. | |
| 4,074,959 | A | 2/1978 | Curry et al. | |
| 4,225,382 | A | 9/1980 | Kearney et al. | |
| 4,333,786 | A | 6/1982 | Civardi et al. | |
| 4,372,997 | A * | 2/1983 | Fritze et al. | 428/144 |
| 4,489,118 | A | 12/1984 | Endres et al. | |
| 4,495,016 | A * | 1/1985 | Viberg et al. | 156/152 |
| 4,738,847 | A | 4/1988 | Rothe et al. | |
| 4,764,418 | A | 8/1988 | Kuenn et al. | |
| 4,824,689 | A | 4/1989 | Kuenn et al. | |
| 4,828,912 | A | 5/1989 | Hossain et al. | |
| 4,897,304 | A | 1/1990 | Hossain et al. | |
| 4,927,588 | A | 5/1990 | Schulz | |
| 4,950,545 | A | 8/1990 | Walter et al. | |
| 5,030,081 | A | 7/1991 | Schulz | |
| 5,093,068 | A | 3/1992 | Schulz | |
| 5,123,343 | A * | 6/1992 | Willer | 101/23 |
| 5,143,776 | A * | 9/1992 | Givens | 428/194 |

(Continued)

FOREIGN PATENT DOCUMENTS

EP 0 506 336 A1 9/1992

(Continued)

OTHER PUBLICATIONS

Cohen, Edward D. and Edgar B. Gutoff, editors, "Choosing the Coating Method," *Modern Coating and Drying Technology*, Chapter 1, VCH Publishers, Inc., New York, 1992, pp. 1-21.

*Primary Examiner*—Sam Chuan Yao
*Assistant Examiner*—Barbara J. Musser
(74) *Attorney, Agent, or Firm*—Scott A. Baum

(57) ABSTRACT

A process for reorienting the plies within a multi-ply web includes the steps of: providing at least two plies, each ply having a first and a second opposing surface; combining the at least two plies together to form a multi-ply web; treating either the first or the second opposing surface of at least one ply of the multi-ply web forming a treated multi-ply web; winding the treated multi-ply web into a roll; unwinding the roll; and changing the orientation of the treated surface within the multi-ply web as the roll is unwound.

48 Claims, 5 Drawing Sheets

U.S. PATENT DOCUMENTS

| | | | | |
|---|---|---|---|---|
| 5,227,242 | A | 7/1993 | Walter et al. | |
| 5,558,873 | A | 9/1996 | Funk et al. | |
| 5,840,403 | A | 11/1998 | Trokhan et al. | |
| 5,840,404 | A * | 11/1998 | Graff | 428/154 |
| 5,980,673 | A | 11/1999 | Takeuchi et al. | |
| 6,054,020 | A | 4/2000 | Goulet et al. | |
| 6,126,784 | A | 10/2000 | Ficke et al. | |
| 6,197,154 | B1 | 3/2001 | Chen et al. | |
| 6,221,211 | B1 | 4/2001 | Hollenberg et al. | |
| 6,231,719 | B1 | 5/2001 | Garvey et al. | |
| 6,238,682 | B1 * | 5/2001 | Klofta et al. | 424/402 |
| 2004/0118530 | A1 | 6/2004 | Kressner et al. | |
| 2005/0089656 | A1 * | 4/2005 | Shiina | 428/34.2 |

FOREIGN PATENT DOCUMENTS

| | | | |
|---|---|---|---|
| EP | 1 096 069 | A2 | 5/2001 |
| WO | WO 00/16974 | A2 | 3/2000 |
| WO | WO 01/45613 | A1 | 6/2001 |
| WO | WO 01/45615 | A1 | 6/2001 |
| WO | WO 01/47700 | A1 | 7/2001 |
| WO | WO 01/49117 | A2 | 7/2001 |
| WO | WO 01/49259 | A2 | 7/2001 |
| WO | WO 01/52713 | A2 | 7/2001 |

* cited by examiner

METHOD FOR CHANGING THE ORIENTATION OF THE PLIES WITHIN A MULTI-PLY PRODUCT

BACKGROUND

The surfaces of webs are often treated to enhance their usefulness. For instance, the surfaces can be printed, embossed, or have various chemicals, lotions or emollients applied to them amongst other treatment possibilities. Frequently, in a product sold with two or more webs combined together, such as a three-ply facial tissue, it can be desirable to treat the middle ply. For instance, virucidal solutions can be a useful treatment to reduce the spread of cold viruses. Virucidal solutions can be irritating to noses; especially, when a person's nose may already be irritated due to a cold or the flu. Thus, placing the virucidal treated ply between the outer plies of the three-ply facial tissue can reduce nasal irritation due to virucidal treated tissues.

In order to treat the middle tissue ply with a virucidal solution without treating the outer plies, converting machinery is needed to separate the three plies so the middle ply can be treated separately, after which the plies are recombined. Another possibility is to treat the middle ply first, and then add the outer plies downstream of the treatment operation. In either case, if a manufacturer does not possess machines having this processing capability they must purchase new converting machines or rebuild existing machines to accommodate the above processes. If the virucidal treated product is needed in limited quantities, the necessary capital expenses can prevent cost effective production of such products. Therefore, what is needed is a process for treating the middle ply of a three-ply web without requiring new or rebuilt converting equipment.

SUMMARY

The inventors have discovered a process for reorientation of a treated ply within a multi-ply product. In one embodiment, the inventors have found that they can treat the outer ply of a multi-ply product and then wind the treated multi-ply web into a roll. A portion of the roll is then unwound, and the plies are reoriented prior to threading a subsequent converting process. As the roll continues unwinding, the ply having the treated outer surface is relocated from its original orientation with respect to the other plies to a new location.

In another embodiment for a three-ply facial tissue, the outer surface of one of the outer plies can be treated with a virucidal solution and the three plies wound into a roll. The treated outer surface ply can then be reoriented during a unique threading operation and placed between the other two plies. After reorientation, the three-ply facial tissue with the new ply orientation can be converted in a conventional manner.

Thus, it is now possible to send wound rolls to another location for treatment, such as printing a virucidal lotion on the outer ply. The treated rolls can then be sent to another location and unwound on existing converting machines while reorienting the plies to locate the treated surface between the other two plies. As such, the desired multi-ply product, with the treated ply between two other plies, can be produced without purchasing or rebuilding machinery.

BRIEF DESCRIPTION OF THE DRAWINGS

The above aspects and other features, aspects, and advantages of the present invention will become better understood with regard to the following description, appended claims, and accompanying drawings:

DEFINITIONS

As used herein "treat" or "treating" means to subject the surface of a web to either a physical action or a chemical application that changes the physical attributes of the surface. The treating processes can include, but are not limited to, flexographic printing, rotogravure printing, offset printing, letterpress, direct gravure coating, offset gravure coating, reverse roll coating, flexographic coating, slot coating, dip coating, rod coating, knife coating, air knife coating, blade coating, slide coating, curtain coating, spraying, hot melt spraying, foam application, brushing, and embossing. Further information on coating methods is disclosed in *Modern Coating and Drying*, Edward Cohen and Edgar Gutoff, 1992 VCH Publishers, Inc.

DETAILED DESCRIPTION

Figure 1:
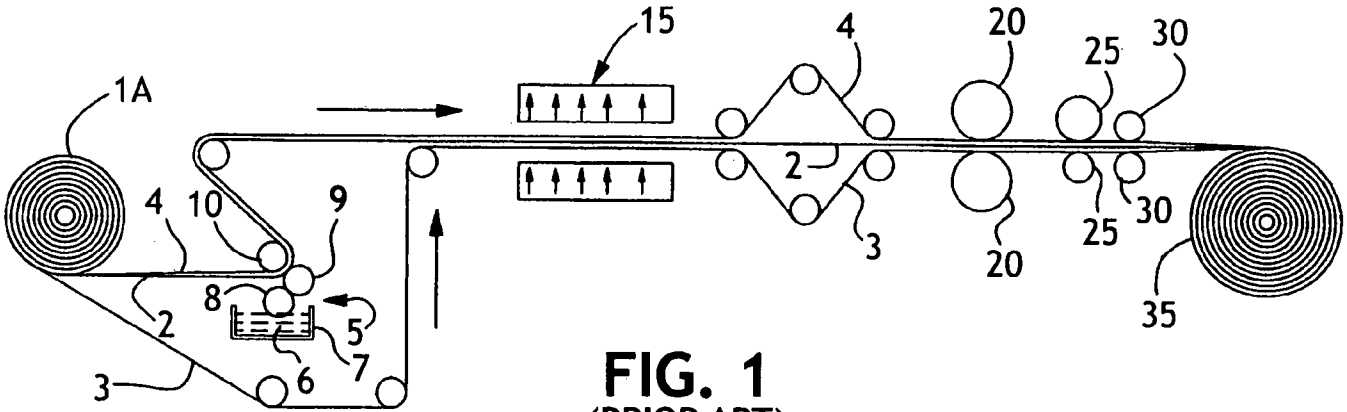
FIG. 1 (PRIOR ART)
FIG. 1 illustrates a prior art process.

Referring to FIG. 1, a prior art process for treating the middle ply of a three-ply tissue web with a virucidal solution is illustrated. The process is disclosed in U.S. Pat. No. 4,738,847 entitled Multi-Ply Virucidal Product that issued on Apr. 19, 1998 to Rothe et al. and herein incorporated by reference. A virucidal treated tissue product is disclosed in U.S. Pat. No. 4,828,912 entitled Virucidal Product Having Virucidal and/or Germicidal Properties that issued May 9, 1989 to Hossain et al. and herein incorporated by reference. Another antimicrobial product is disclosed in U.S. patent application 60/174,088 entitled Antimicrobial Absorbent Article and Methods of Making and Using the Same filed on Dec. 30, 1999 and herein incorporated by reference.

In the process illustrated in FIG. 1, three plies of tissue were unwound from a single roll 1A at a speed of 1000 ft/min. Each of the plies had a basis weight of 9 pounds per 2880 square feet. In order to apply the virucidal composition to the inner ply 2, one of the outer plies 3 was separated from plies 2 and 4 as illustrated. Plies 2 and 4 were passed through a Dahlgren liquid application system 5 which printed a metered amount of the virucidal composition onto the inner ply 2. The virucidal composition 6 consisted of a solution containing 37.4 weight percent citric acid, 18.7 weight percent malic acid, 7.5 weight percent sodium lauryl sulfate, and 63.4 weight percent water.

The Dahlgren unit comprised a solution reservoir 7, a metering roll 8, a transfer roll 9, and a back-up roll 10. The virucidal solution was picked up by the metering roll, transferred to the transfer roll, and applied to the center ply in a nip between the transfer roll and the back-up roll. The dry virucidal composition solids add-on rate, based on the air dry weight of the center ply 2, was about 6.1 mg. per square inch. It will be appreciated that the solids add-on rate can be adjusted for the particular virucidal composition being used. Also, there can be some bleed-through or migration of the virucidal solution to the outer plies 4 and 3 during and after printing due to the absorbent character of the plies and the viscosity of the virucidal solution chosen. However, the amount of migration or bleed-through is to be minimized to reduce any chances of nasal tissue irritation during normal use of the product. The virucidal composition, in one embodiment, is concentrated near the inner surface of the outer ply 4. Application of the virucidal composition can be accomplished by means other than printing, such as spraying, extrusion, foam application, or dipping.

After applying the virucidal composition to the center ply 2, the outer ply 3 was recombined with the other two plies and the three plies were passed through a flat bed throughdrier 15. Hot air having a temperature of 260° F. and a flow rate of 20,000 $ft^3$/min. was supplied to the throughdrier to dry the three-ply product.

Depending on the specific virucidal solution used, the composition can migrate from the inner ply to the outer plies and adhere the inner ply to the two outer plies during drying, commonly referred to as "blocking". To minimize blocking, the three plies were separated and thereafter recombined after drying. This operation eliminated the blocking problem and reduced the stiffness of the composite sheet. Use of different solutions or different application rates can eliminate blocking such that this step is not always required.

The recombined three-ply web was then calendered by passing through a pair of calender rolls 20 to achieve proper caliper and to improve the desired bulk and smoothness characteristics. After calendering, the three-plies were crimped together by suitable crimp rolls 25 and slit by suitable slitters 30 to a suitable width and wound onto a roll 35 for converting and packaging into facial tissues in a conventional manner.

Figure 2:
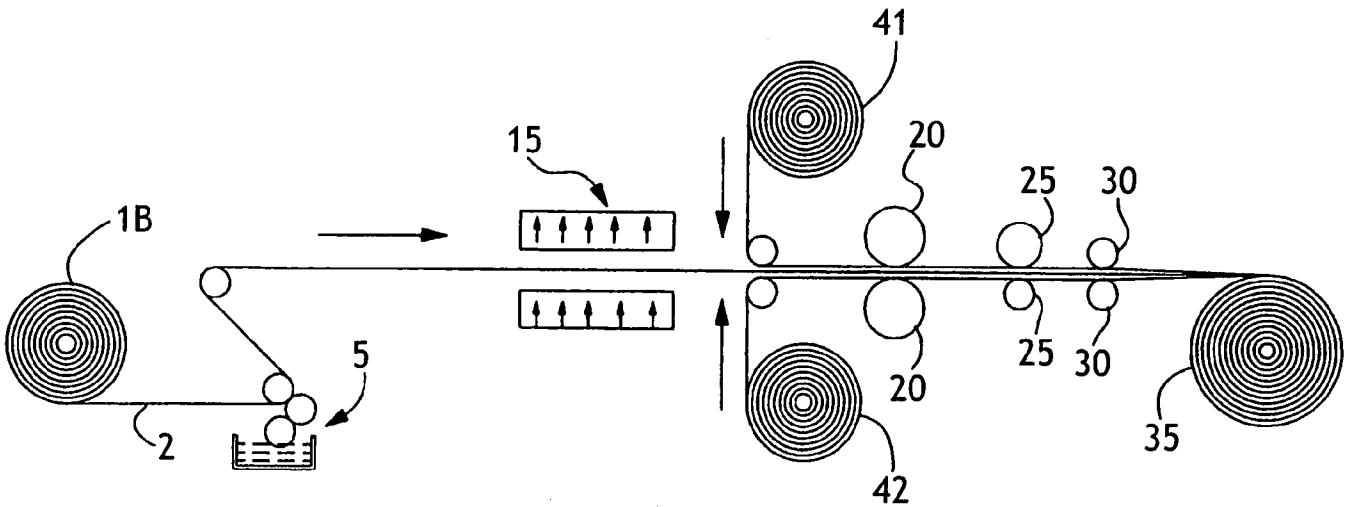
FIG. 2 (PRIOR ART)
FIG. 2 illustrates a prior art process.

Referring now to FIG. 2, another prior art process for treating the middle ply of a three-ply web is illustrated. A single ply 2 to be treated with a virucidal composition is unwound from a supply roll 1B and treated with the virucidal composition, as by printing, extruding, or spraying the virucidal composition on one or both surfaces of the ply. The treated ply is then dried and placed between two untreated plies supplied from supply rolls 41 and 42. The 3-ply composite web is then calendered, crimped, slit, and wound onto a roll for subsequent converting as illustrated. By treating and drying the inner ply independently of the outer two plies, the potential blocking problem described above is avoided.

While these prior art processes are useful in the production of a virucidal tissue, if the manufacturer does not possess such equipment or if the production needs exceed existing capacity, new equipment must be bought or the existing equipment modified. The inventors have solved this problem by a unique process that treats the outer surface of a multi-ply web and then relocates that surface in subsequent converting operations to become a middle ply.

Figure 3:
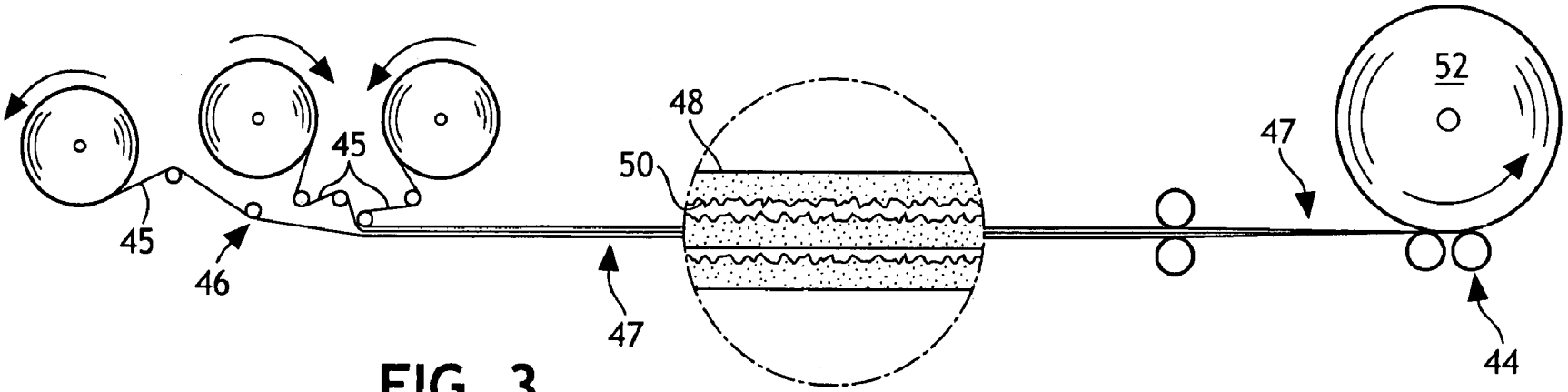
FIG. 3 illustrates a first converting machine.

Referring now to FIG. 3, a first converting machine having a winder 44 and an unwind 46 with the capability to unwind three individual webs or plies 45 is illustrated. The three individual plies 45 are unwound and combined in a face-to-face relationship to form a multi-ply web 47. Each individual ply 45 has a first surface 48 and a second surface 50 that are opposing. The converting machine may have calendering, crimping, embossing, or slitting equipment that can be used as needed. In one embodiment, the individual webs 45 are combined to form the multi-ply web 47, and wound into a roll 52 without calendering or slitting.

If desired, the three individual plies 45 can be attached together. Methods of attachment can include crimping, ultrasonic bonding, and adhesive bonding. Specifically, only a portion of a length of the multi-ply web 47 can be crimped together to aid in maintaining the individual plies' orientation within the multi-ply web for threading a subsequent process illustrated in FIG. 5. In one embodiment, the crimping was confined to the outer wraps of the multi-ply web 47 on the roll 52 such as the last approximately 100–200 yards of the multi-ply web wound onto the roll. At this point, the roll 52 can be stored for further processing or sent to another location or manufacturing facility, such as a contract converter, for further processing.

In the illustrated embodiment, the individual plies 45 are creped tissue webs that are often referred to as a wet-pressed tissue. However, the invention is not limited to webs of tissue such as bath tissue, paper towels, or facial tissue. Any web material capable of being wound into a roll is encompassed by the present invention. Suitable webs can include films, plastics, nonwovens, paper, cardboard, metallized films, and thin metals. In addition, the individual plies 45 can be different materials instead of the same material as illustrated. For instance, a nonwoven web and a tissue web can be plied together. Any type of similar or dissimilar web materials can be used.

Figure 4:
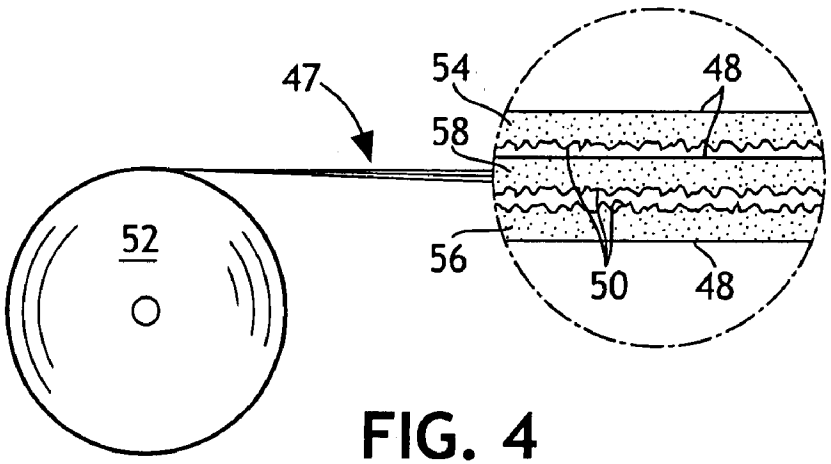
FIG. 4 illustrates the ply orientation after winding.

Creped tissue webs can have one surface that has less topography or texture than the other surface. The surfaces are often referred to as the felt side (FS) and the dryer side (DS). In the figures, the first surface 48 is the felt side 48 and is illustrated as a straight line. The second surface 50 is the dryer side 50 and is illustrated by a wavy or irregular line. In tissue making it is generally known that the dryer side can be perceived as smoother or softer and this side is exposed in the finished product. Thus, it is important to properly orientate the felt and dryer sides of each individual ply such that after the plies are reoriented, as discussed later, the desired side is exposed in the multi-ply finished product. FIG. 4 illustrates one possible orientation for the each of the plies first and second surfaces (48, 50) within the multi-ply web 47 wound into roll 52. The multi-ply web 47 has a first outer ply 54, a second outer ply 56, and a middle ply 58. Of interest is the fact that the felt side 48 of both outer plies forms both exterior surfaces of the multi-ply web 47, which is the opposite of conventional practice wherein the multi-ply web 47 would be plied together such that the dryer side 50 of both outer plies formed both exterior surfaces of the multi-ply web.

Figure 5:
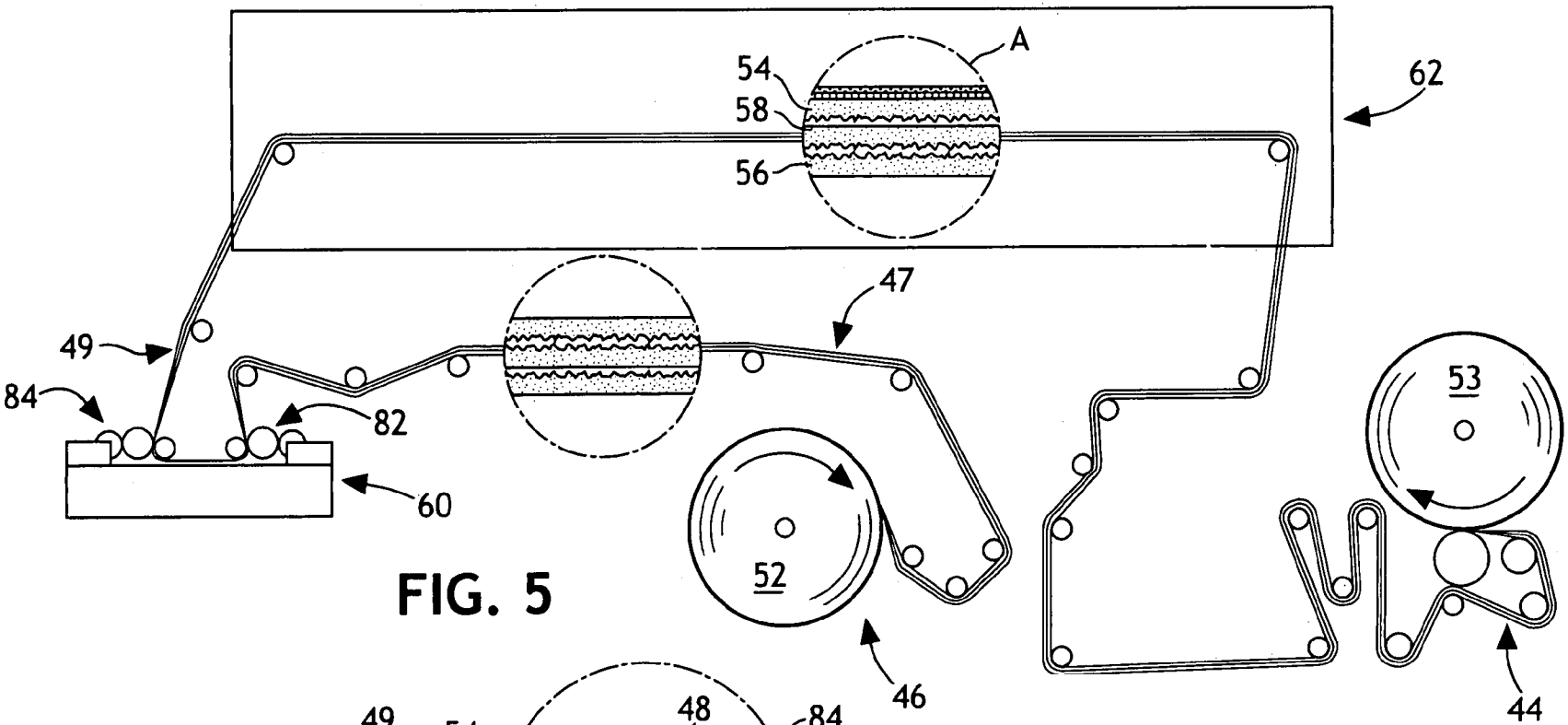
FIG. 5 illustrates a second converting machine for printing a virucidal solution.

Referring now to FIG. 5, a second converting machine having an unwind 46, a printer/coater 60, a dryer 62, and a winder 44 is illustrated. The machine is used to treat the multi-ply web 47 by ink printing a visual cue 82 and then printing a virucidal solution 84 onto the first surface 48 of the first outer ply 54. After printing the first surface 48 with ink and the virucidal solution, the treated multi-ply web 49 is dried and rewound into roll 53. Alternatively, the web can be virucidal printed, ink printed and dried; or virucidal printed, dried and ink printed; or ink printed, dried, virucidal printed and dried; or virucidal printed, dried, ink printed and dried.

In the illustrated embodiment, a multi-ply web 47 comprising 3 tissue plies passes through a four (4) station flexographic central impression printer utilizing two (2) of the printing stations. In the first station, a visual cue is ink printed onto the first surface 48 (felt side) of the first outer ply 54. The visual cue printing is accomplished using a 360 line screen laser engraved ceramic anilox roll with a volume of 4.6 billion cubic microns per square inch (BCM). A water base cyan pigment ink supplied by Sun Chemical Corporation having an office in Menasha, Wis. was used to print the visual cue. The resulting print coverage was approximately 5% of the total tissue surface area.

The second flexographic station in the central impression process applied 60% solids (active ingredients to water) virucidal solution mixed at a ratio 2.02 parts Sodium Lauryl Sulfate (SLS) to 7.53 parts citric acid. SLS is available from Cognis having an office in Hoboken, N.J. Citric acid is available from Archer Daniels Midland having an office in Decatur, Ill. The virucidal solution is picked up by a metering roll from a reservoir in the fountain style press and transferred to an engraved roll. The laser engraved ceramic anilox roll has a 165 line screen with a transfer volume of 8.7 BCM. The virucidal solution transfers from the cells of the engraved roll to the surface of a transfer roll designed to uniformly apply the solution to the first surface 48 of the first outer ply 54 in the nip between the transfer roll and a backing roll. The resulting virucidal solution transfer rate was measured to be approximately 2.2 mg per square inch of tissue surface after air drying.

Since the application of the water based virucidal solution wets or moistens the treated multi-ply web 49, the treated multi-ply web passes through an air flotation dryer. The dryer has 2 burners with heating capability of 1.2 BTU per burner. Typical dryer temperatures ranged from about 250° F. to about 280° F. to dry the treated multi-ply web 49 to the preferred moisture level with a web speed of 1000 ft/min. The resulting treated multi-ply web 49 was sufficiently dry at this point and ready for additional processing.

In the above process, the second converting machine was located at converter having separate manufacturing facilities. Thus, the necessary treatment can be contracted if suitable equipment is not available in-house at the manufacturing location. Furthermore, it is not necessary to use the process methods illustrated in FIGS. 1 or 2 to apply the virucidal solution, as the virucidal treated ply will be relocated in a subsequent operation.

In another embodiment, the visual cue or internal indicia can be eliminated; however, the cue is useful to tell a consumer that the tissue has been specially treated and it assists employees in identifying and relocating the treated ply to its correct location in the finished product. Further information on visual cues or indicia is disclosed in U.S. Pat. No. 6,221,211 entitled Multi-Ply Tissue Having Internal Indicia issued to Hollenburg et al. on Apr. 24, 2001, and herein incorporated by reference. In one embodiment, the visual cue had a pattern as disclosed in U.S. patent application Ser. No. 10/325,469 entitled Nonwoven Products Having A Patterned Indicia filed on Dec. 19, 2002, and herein incorporated by reference.

In another embodiment, any suitable chemical can be applied to either or both exterior surfaces of the multi-ply web to form the treated multi-ply web 49. Suitable chemicals can include strength agents, barrier agents, cleaning agents, surfactants, lotions to improve 10 softness, absorbency enhancers, aesthetic additives, or mixtures thereof. Suitable chemicals for obtaining these and other properties are disclosed in U.S. Pat. No. 5,840,403 issued to Trokhan et al. on Nov. 24, 1998, and in U.S. Pat. No. 6,126,784 issued to Ficke et al. on Oct. 3, 2000, the disclosures of both herein incorporated by reference.

Figure 6:
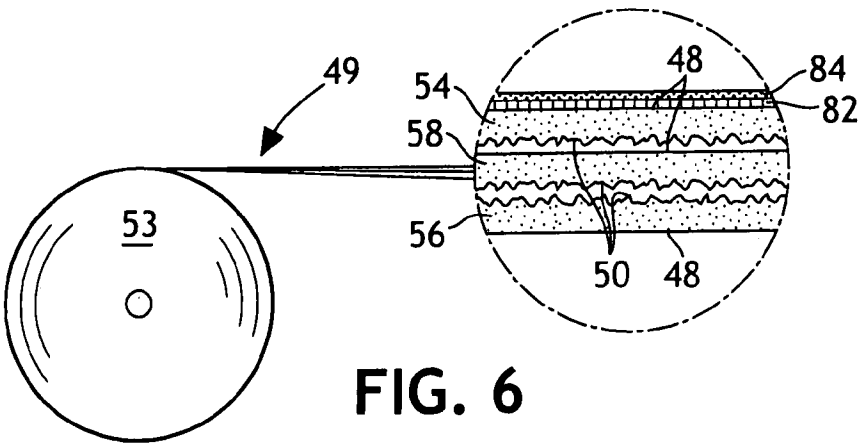
FIG. 6 illustrates the ply orientation after printing a virucidal solution and winding.

Referring now to FIG. 6, the orientation for each ply within the treated multi-ply web 49 wound into roll 53 is illustrated. As seen, the orientation is the same as FIG. 4, but the first surface 48 of the first outer ply 54 has been treated as illustrated by applying the visual cue 82 and the virucidal coating 84. Reorientation of the treated surface to between the other plies occurs in a subsequent operation.

If desired, the three individual plies can be attached together. Methods of attachment can include crimping, ultrasonic bonding, and adhesive bonding. Specifically, only a portion of the length of the treated multi-ply web 49 can be crimped together to aid in maintaining the individual plies' orientation for threading a subsequent process illustrated in FIG. 7. In one embodiment, the crimping was confined to the outer wraps of the treated multi-ply web 49 on the roll 52 such as the last approximately 100–200 yards of the treated multi-ply web wound onto the roll. In another embodiment, the crimping is eliminated since the visual cue has been printed onto the treated ply 54. The visual cue helps machine operators identify the treated ply needing reorientation.

Figure 7:
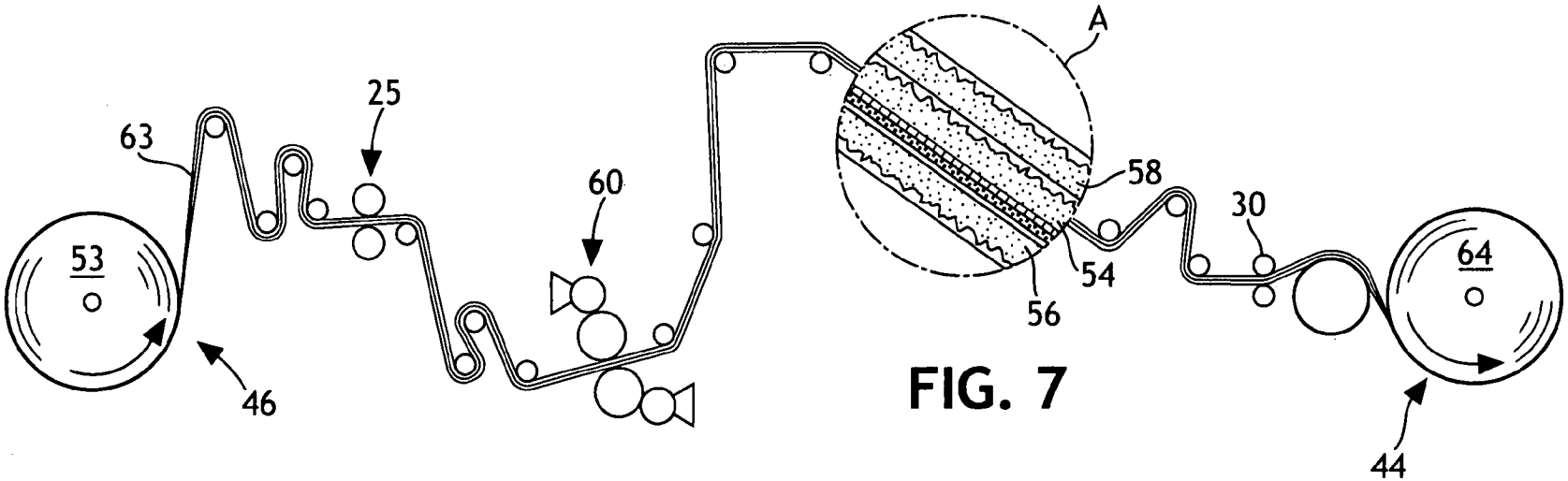
FIG. 7 illustrates a third converting machine for printing a polysiloxanne lotion.

Referring now to FIG. 7, a third converting machine having an unwind 46, a printer/coater 60, crimping rolls 25, slitters 30, and a winder 44 is illustrated. The roll 53, after treating as illustrated in FIG. 6, is placed in the unwind 46. During threading of the third converting machine, the orientation of the plies 45 is intentionally altered changing the orientation of at least one of the plies forming a reoriented multi-ply web 63 that can be wound into a second roll 64. Roll 64 can then be stored or utilized by a fourth converting machine, such as an interfolder or multifolder, for conversion of the reoriented multi-ply web 63 into boxed facial tissues as is known in the art. By comparing the individual plies' orientations at point A in FIGS. 5 and 7, it is seen that the printed virucidal treated surface is now between the two outer plies at 7A, while at 5A, the virucidal treated surface is on the outer ply. Thus, as a result of the threading operation, the plies are intentionally reoriented to form the reoriented multi-ply web 63. The reorientation process during threading is intentionally repeated for every roll 53 placed in the unwind 46 in order to form the reoriented multi-ply web 63 that is wound into the second roll 64.

Figure 8:
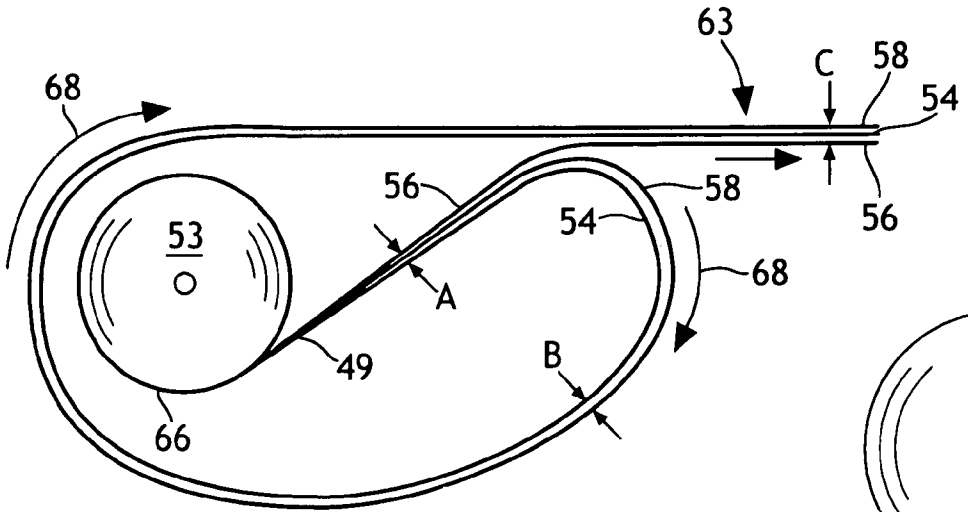
FIG. 8 illustrates reorientation of the plies prior to threading a converting machine.

Referring now to FIG. 8, one means of reorienting the plies during threading is illustrated in more detail. A portion of the treated multi-ply web 49 of the roll 53 is unwound. The initial unwound portion is bracketed by arrows as A in FIG. 8. The orientation of the individual plies 45 in relation to each other within the treated multi-ply web 49 in the unwound portion A is identical to the orientation of the plies after treating in FIG. 6. The machine operator then separates the first outer ply 54 and the middle ply 58 from the second outer ply 56. The separated portion B is bracketed by arrows in FIG. 8. The machine operator then threads the separated portion B around the roll's periphery 66 as indicated by an arrow 68. The separated portion B is then brought back into contact with the remaining portion of the treated multi-ply web 49, in this case the second outer ply 56, creating a reoriented multi-ply web 63 that is bracketed by arrows at C. The reoriented multi-ply web portion C is then threaded through the machine in a conventional manner.

The threading operation changes the location (orientation) of the first outer ply 54 with respect to the other plies in the multi-ply web, since the first outer ply is now placed between the second outer ply 56 and what was the middle ply 58, but now the middle ply 58 actually becomes a new outer ply. In addition, the felt side and the dryer sides of the plies are reoriented after winding the reoriented multi-ply web 63 into the second roll 64 when compared to the roll 52 in FIG. 4. Compare the location of the plies and their respective first and second surfaces (48, 50) in FIG. 4 to those in FIG. 9. Now the outer most plies in FIG. 9 (58 and 56) have their drier sides (50) exposed. In FIG. 4, the outer most plies (54 and 56) have the felt sides (48) exposed rather than the dryer sides (50). Not only is the virucidal treated ply reoriented to a middle ply as a result of the inventive method, but the dryer side surfaces 50 of the outer plies are also reoriented to be both exposed surfaces in the reoriented multi-ply web 63 that becomes the finished tissue product.

In an alternative embodiment of the invention, the machine operators, instead of unwinding portion A of the treated multi-ply web, threading only a select number of plies shown as portion B about the roll's periphery, and then combining the portion B with the remaining ply(s), can instead practice a technique known as "dropping a ply". In this threading operation in one embodiment, the machine operators make a "grab" of the final desired ply orientation within the roll 53 by observing the printed visual cue and ensuring that the printed ply is present between the desired two outer plies in the grabbed portion taken for threading the machine. Since the tissue is relatively weak, the operators can grab the desired reoriented multi-ply web portion and then rip or strip off the remaining outer layer or layers from the roll, which then fall to the floor leaving the operator with a reoriented multi-ply tail for threading the machine having the plies orientated as shown in portion C of FIG. 8.

It should be noted that the operators can drop one or more plies during the threading operation as needed to form the reoriented multi-ply web 63. For the illustrated process, the operators actually drop two plies 54 and 58, the B portion of FIG. 8, which are then ripped or stripped from the roll prior to threading to obtain the C portion tail for threading the machine.

Referring again to FIG. 7, after the individual plies 45 have been reoriented, the crimp rolls 25, or other attachment method, are used to hold the reoriented multi-ply web 63 together in the final orientation. However, unlike previously, in general the entire length of the reoriented multi-ply web 63 is crimped together. Previously, only a small portion of the length of the multi-ply web was crimped for initial threading purposes such that in the remaining length of the multi-ply web the individual plies could be separated and reoriented as discussed above. The slitters 30 are used to cut the reoriented multi-ply web 63 to the desired width for the product being produced. While the web is shown being wound into the second roll 64, it is possible to use other converting equipment, such as an interfolder to directly produce stacks of folded facial tissue, and thereby skip the winding operation.

After crimping, the reoriented multi-ply web 63 can pass through a gravure coater 60 that applies a chemical to either or both of the now reoriented outer surfaces of the multi-ply web. Suitable chemicals can include strength agents, barrier agents, cleaning agents, surfactants, lotions for improved softness, absorbency enhancers, or aesthetic additives. Suitable chemicals for obtaining these and other properties are disclosed in U.S. Pat. No. 5,840,403 issued to Trokhan et al. on Nov. 24, 1998, and in U.S. Pat. No. 6,126,784 issued to Ficke et al. on Oct. 3, 2000.

In one embodiment, the coater applied a polysiloxane composition to either or both exterior surfaces of the reoriented multi-ply web 63. The silicone, such as FTS-226 available from Sun Chemical Company having an office in Carlstadt, N.J., was applied to both exterior surfaces, after reorienting the plies, at a rate of 1% by weight (air dried weight) of the reoriented multi-ply web using a 4-roll simultaneous offset gravure coater. The coater consisted of two chambered applicators, two engraved rolls, and two transfer rolls. Typical engraved volumes to achieve the target addition rate are 1.25 BCM using the electro mechanical engraving process. The transfer rolls are cast polyurethane. Silicone transfer is achieved by nipping the tissue between the facing transfer rolls.

Figure 9:
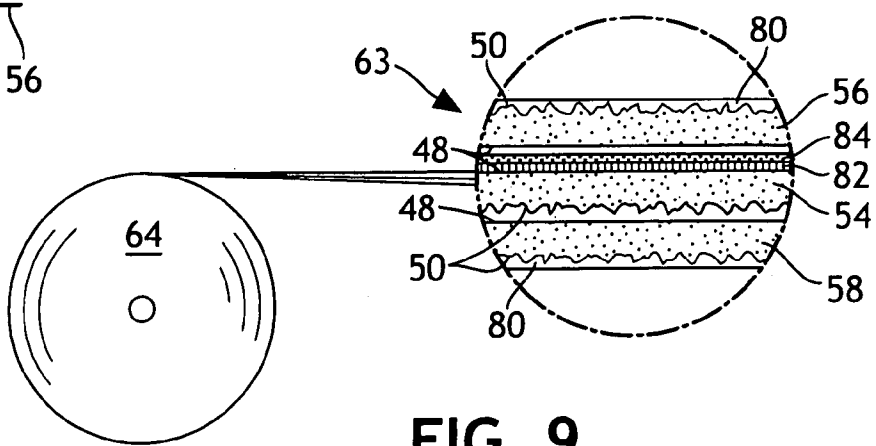
FIG. 9 illustrates the ply orientation after reorientation.

Referring to FIG. 9, in the final form the treated reoriented multi-ply web 63 comprises a polysiloxane coating 80 on the second surfaces 50 (drier sides) of the reoriented exterior plies (58 and 56). The reoriented middle ply (54) comprises an ink printed visual cue 82 and a printed virucide 84 applied to the first surface 48 (felt side). The treated multi-ply web wound into the second roll 64 can be folded and packaged into facial tissue as known in the art by placing the second roll into a fourth converting machine. The treated multi-ply web is an exemplary tissue product for use while suffering from a cold. The virucidal coating kills cold viruses helping to prevent transmitting or spreading the cold to others and the polysiloxane coating on the exterior plies is soothing to irritated nasal tissues.

Polysiloxane treated tissue sheets are described in U.S. Pat. No. 4,950,545 issued to Walter et al. on Aug. 21, 1990; U.S. Pat. No. 5,227,242 issued to Walter et al. on Jul. 13, 1993; U.S. Pat. No. 5,558,873 issued to Funk et al. on Sep. 24, 1996; U.S. Pat. No. 6,054,020 issued to Goulet et al. on Apr. 25, 2000; and in U.S. Pat. No. 6,231,719 issued to Garvey et al. on Apr. 25, 2000, the disclosures of each herein incorporated by reference.

While the forgoing process may appear complicated, it is quite straight forward from a manufacturing perspective. Furthermore, the inventive method can be accomplished in fewer steps for different product forms other than the one described above. With regard to virucidal treated tissues, a two-ply product can be made using a similar process by printing the virucidal solution onto one of the outside surfaces of the outer plies and then relocating the treated surface to become one of the inner surfaces of the two-ply finished product. For any multi-ply web, the inventive method can be achieved in one winding and unwinding sequence.

Figure 10:
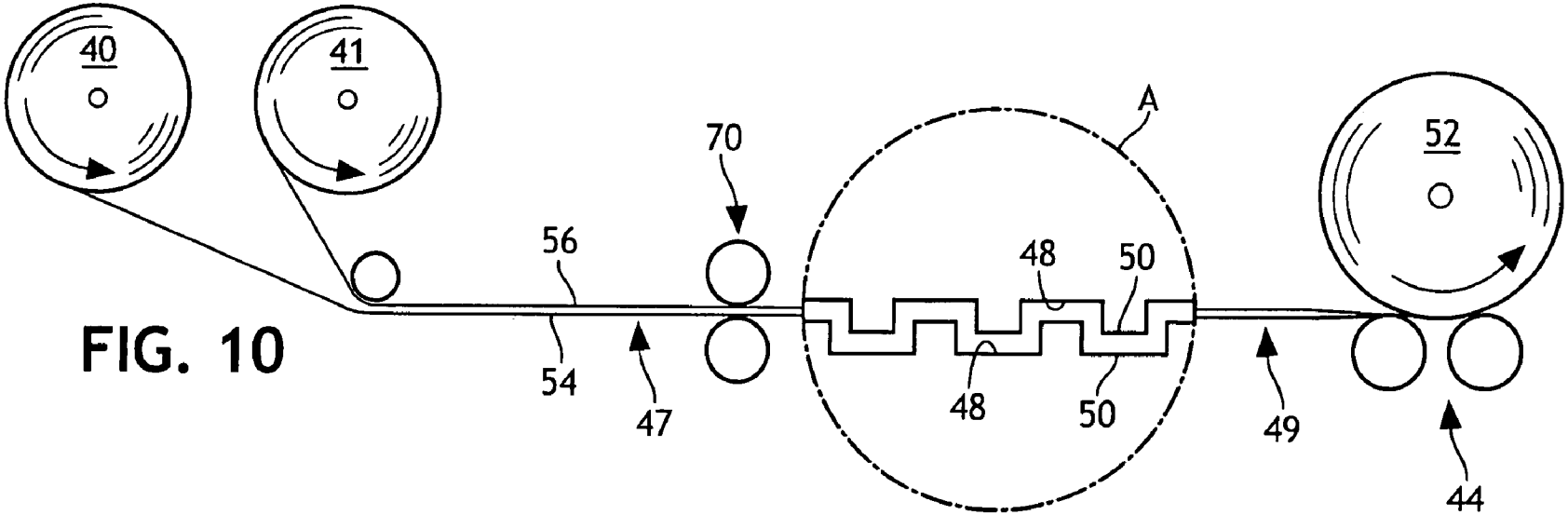
FIG. 10 illustrates a converting machine for embossing.

Referring now to FIG. 10, another converting machine is illustrated having an unwind 46, an embosser 70, and a winder 44. Supply rolls 40 and 41 unwind a first outer ply 54 and a second outer ply 56 forming a multi-ply web 47. The multi-ply web 47 is treated by the embosser 70 using a conventional embossing method such as steel/rubber or matched steel embossing to form a treated multi-ply web 49. The embossed plies have the orientation as shown enlarged at 10(A) prior to being wound into the roll 52. As illustrated in 10(A), the plies are oriented such that the first surface 48 of the first outer ply 54 contacts the first surface 48 of the second outer ply 56. The second surfaces 50 of each ply (54, 56) form the outer surfaces of the treated multi-ply web 49.

Figure 11:
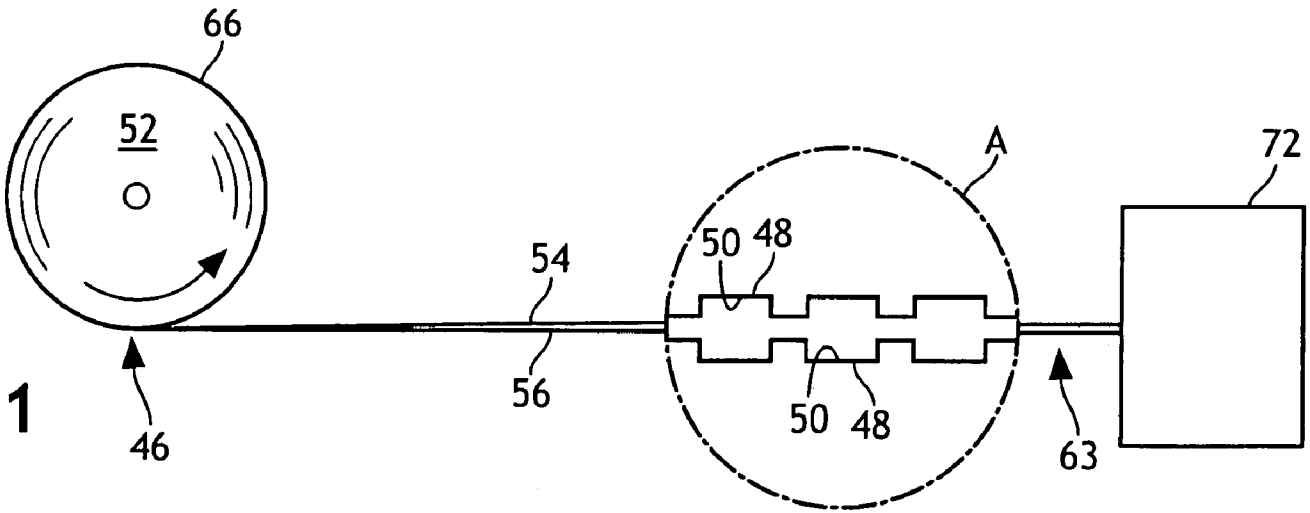
FIG. 11 illustrates reorientation of the plies upon threading a converting machine.

Referring now to FIG. 11, the roll 52 is placed in an unwind stand 46 and one of the plies (54, 56) is intentionally reoriented prior to threading a machine 72. The machine can be any useful web handling machine such as an interfolder, a multifolder, a converting line, a printing line, a bath/towel winder, etc. The reorientation of the plies can follow a process similar to FIG. 8 by threading one of the plies (54, 56) around the periphery 66 of the roll 52. The separated ply is then brought back into contact with the remaining ply forming the reoriented multi-ply web 63 after which the machine 72 is threaded in a conventional manner. Alternatively, the machine operator can "drop a ply" on the unwind 46 forming the reoriented multi-ply web 63 prior to threading the machine 72. The reoriented plies of the reoriented multi-ply web 63 are illustrated at 11(A). As seen, the plies are oriented such that the second surface 50 of the first ply or web 54 contacts the second surface 50 of the second ply or web 56. The first surfaces 48 of each ply now form the outer surfaces of the reoriented multi-ply web 63.

Since the plies have been reversed and offset relative to each other from the reorientation, the resulting bulk of the reoriented multi-ply web 63 at point 11(A) is much greater than the bulk of the treated multi-ply web 49 at point 10(A). This is a direct result of the individual plies no longer being nested together after reorienting the plies. As a result, the bulk of any products produced by the machine 72 will be enhanced.

One advantage of the present invention is that the treatment operation or any of the separate converting operations can occur at other manufacturing locations affording significant manufacturing flexibility. The rolls can be transported or shipped between converting locations as needed without having all of the necessary converting machines located in one manufacturing line at one location in the required order to produce the desired product. For instance, specialized coaters/printers not present within the manufacturers' own manufacturing facilities can be utilized without having to purchase the equipment and install it into existing production lines. Alternatively, the treatment process can be isolated from the production of other products for quality control, or to comply, if necessary, with regulatory requirements concerning the manufacturing processes. The regulatory requirements may be related to volatile organic compound emissions for air quality or to manufacturing best practices for class I medical devices as regulated by the Food and Drug Administration.

Another advantage of the inventive method is the significant increase in productivity that results. Lighter basis weight plies that are combined into the multi-ply web 47 can be prone to web breaks since the individual plies are relatively weak. In the inventive method after the individual plies are combined, the multi-ply web is run through each machine, including the printing/coating operation, with all the plies staying together. Because a multi-ply web can be significantly stronger than any one of its individual plies, the number of web breaks can be greatly reduced by the inventive method. In the prior art processes of FIGS. 1 and 2, a single ply web is run through the printing/coating operation. The single ply separated out for coating can be especially prone to web breaks from its lighter basis weight and being coated with a liquid. In the inventive method, the entire multi-ply web is run through the coater reducing the number of web breaks during the coating operation.

Another advantage of the inventive method is the ability to treat both outer surfaces of the multi-ply web 47 and to reorient both of the treated surfaces to another location within the reoriented multi-ply web 63 that forms the final product. The treatment placed on each surface can be the same or different depending on the desired finished product.

Another advantage of the inventive method is the ability to treat and reorient the multi-ply web 47 two, three, or multiple times until the desired final reoriented treated multi-ply web configuration is achieved. For example, a first treatment could be performed on one or both exterior surfaces of the multi-ply web and the treated multi-ply web wound into a roll. The treated multi-ply web can be reoriented to form a first reoriented multi-ply web as the roll unwinds after which the first reoriented multi-ply web can be treated with a second treatment and wound into a second roll. As the second roll is unwound, the first reoriented multi-ply web could be reoriented a second time to form a second reoriented multi-ply web.

Another advantage of the inventive method is an automatic reduction in blocking that was discussed with the prior art processes. Surprisingly and unexpectedly, the inventors have discovered that the printed plies can be wound into a roll after drying without the previously needed separation step prior to winding. Because at least one of the individual plies can be stripped apart from the remaining plies of the multi-ply web 47 while the roll 52 is unwinding to form the reoriented multi-ply web 63, some or all of the plies are automatically separated eliminating or reducing the previously discussed blocking problem. This eliminates the need to use other equipment to separate the plies as shown in FIG. 1. This was unexpected since it was thought that during winding and storing of the roll, the compressive forces acting on a treated or virucidal printed multi-ply web would "glue" the plies together similar to clamping two work pieces together after applying adhesive. It was thought that the plies could be stuck together too firmly such that attempts at separation would result in ripping or tearing of the plies during unwinding instead of the desired reorientation.

It will be appreciated that the foregoing description, given for the purposes of illustration, is not to be construed as limiting the scope of the invention, which is defined by the claims and all equivalents thereto. Specifically, although the inventive method has been described with either two- or three-ply webs, the inventive method can be practiced with multi-ply webs having any number of plies.

We claim:

1. A method comprising the steps of:

providing at least two plies, each ply having a first and a second opposing surface;

combining the at least two plies together to form a multi-ply web treating either the first or the second opposing surface of at least one ply of the multi-ply web forming a treated multi-ply web wherein the treating process is selected from the group consisting of flexographic printing, rotogravure printing, offset printing, letterpress, direct gravure coating, offset gravure coating, reverse roll coating, flexographic coating, slot coating, dip coating, rod coating, knife coating, air knife coating, blade coating, slide coating, curtain coating, spraying, hot melt spraying, foam application, brushing, and embossing;

winding the treated multi-ply web into a roll;

changing the location of the treated surface within the multi-ply web to form a reoriented multi-ply web;

unwinding the roll; and winding the multi-ply web into a second roll after changing the location of the treated surface.

2. The method of claim 1 wherein the treating comprises applying a chemical to either the first or the second surface.

3. The method of claim 2 wherein the treating comprises printing a virucidal solution on either the first or second surface.

4. The method of claim 2 wherein the treating comprises printing an ink on either the first or second surface.

5. The method of claim 2 wherein the treating comprises printing a virucidal solution and printing an ink on either the first or the second opposing surface.

6. The method of claim 1 wherein the treating comprises embossing either the first or second opposing surface.

7. The method of claim 1 comprising attaching the plies together of the multi-ply web before winding the multi-ply web into a roll and wherein only a portion of a length of the multi-ply web is attached together within the wound roll and another portion of the length of the multi-ply web is not attached together within the wound roll.

8. The method of claim 7 wherein the attaching comprises crimping.

9. The method of claim 1 wherein the plies comprise the same material.

10. The method of claim 1 wherein the plies comprise different materials.

11. The method of claim 9 wherein the plies comprise either bath tissue, paper towels, or facial tissue.

12. The method of claim 10 wherein the plies comprise a tissue web and a nonwoven web.

13. The method of claim 1 comprising threading a machine after changing the location of the treated surface.

14. The method of claim 1 wherein the first surface of a first ply contacts the first surface of a second ply in the multi-ply web, and, after changing the location of the treated surface, the second surface of the first ply contacts the second surface of the second ply in a reoriented multi-ply web.

15. The method of claim 1 wherein changing the location of the treated surface comprises dropping a ply to form a the reoriented multi-ply web.

16. The method of claim 15 comprising threading a machine with the reoriented multi-ply web.

17. The method of claim 1 wherein changing the location of the treated surface comprises:

unwinding a portion of the treated multi-ply web from the roll;

separating at least one ply from the unwound portion of the treated multi-ply web;

threading the separated at least one ply around a periphery of the roll;

bringing the separated at least one ply into contact with the remaining unwound portion of the treated multi-ply web to form a reoriented multi-ply web; and threading a machine with the reoriented multi-ply web.

18. The method of claim 16 or 17 wherein the machine comprises a folding machine.

19. The method of claim 16 or 17 wherein the machine comprises a winder.

20. The method of claim 16 or 17 wherein the machine comprises a printer.

21. The method of claim 19 comprising crimping the reoriented multi-ply web.

22. The method of claim 1 comprising forming a first reoriented multi-ply web as the roll is unwound, winding the first reoriented multi-ply web into the second roll, and changing the location of the first reoriented multi-ply web as the second roll is unwound to form a second reoriented multi-ply web.

23. A method comprising the steps of:

combining a first outer ply, a middle ply, and a second outer ply forming a multi-ply web;

treating a surface of the first or the second outer ply forming a treated multi-ply web;

winding the treated multi-ply web into a roll;

changing the location of the first or the second outer ply to become the middle ply of a reoriented multi-ply web;

unwinding the roll;

threading a machine with the reoriented multi-ply web; and treating at least one outside surface of the reoriented multi-ply web.

24. The method of claim 23 wherein the treating comprises applying a chemical on the surface.

25. The method of claim 24 wherein the treating comprises applying a virucidal solution on the surface.

26. The method of claim 25 wherein the treating comprises printing a visual cue on the surface.

27. The method of claim 23 wherein changing the location of the first or second outer ply comprises dropping at least one of the plies.

28. The method of claim 24 wherein the orientation of the multi-ply web is intentionally changed to form the reoriented multi-ply web for each successive roll that is unwound during production in a manufacturing operation.

29. The method of claim 23 wherein changing the location of the first or the second outer ply comprises:

unwinding a portion of the treated multi-ply web from the roll;

separating at least one ply from the unwound portion of the treated multi-ply web;

threading the separated at least one ply around a periphery of the roll; and bringing the separated at least one ply into contact with the remaining unwound portion of the treated multi-ply web to form a reoriented multi-ply web.

30. The method of claim 29 wherein the orientation of the multi-ply web is intentionally changed to form the reoriented multi-ply web for each successive roll that is unwound during production in a manufacturing operation.

31. The method of claim 23 comprising winding the reoriented multi-ply web forming a second roll.

32. The method of claim 23 wherein the treating at least one outside surface of the reoriented multi-ply web comprises applying a chemical.

33. The method of claim 32 wherein the treating at least one outside surface of the reoriented multi-ply web comprises printing a polysiloxane composition onto both of the outside surfaces.

34. A method comprising the steps of:

combining a first outer tissue paper ply having a felt side and a dryer side with a second outer tissue paper ply having a felt side and a dryer side forming a multi-ply web wherein the felt sides of the first and second outer plies form both exterior surfaces of the multi-ply web;

treating at least one of the exterior felt side surfaces forming a treated multi-ply web;

winding the treated multi-ply web into a roll;

changing the location of the first or the second outer ply to form a reoriented multi-ply web wherein the dryer sides of the exterior plies form both exterior surfaces of the reoriented multi-ply web;

threading a machine with the reoriented multi-ply web; and unwinding the roll.

35. The method of claim 34 comprising combining the first outer tissue ply and the second tissue outer ply with a middle tissue ply.

36. The method of claim 34 wherein changing the location comprises dropping a ply.

37. The method of claim 35 wherein changing the location comprises dropping a ply.

38. The method of claim 34 wherein changing the location comprises:

unwinding a portion of the treated multi-ply web from the roll;

separating at least one ply from the unwound portion of the treated multi-ply web;

threading the separated at least one ply around a periphery of the roll; and bringing the separated at least one ply into contact with the remaining unwound portion of the treated multi-ply web to form the reoriented multi-ply web.

39. The method of claim 35 wherein changing the location comprises:

unwinding a portion of the treated multi-ply web from the roll:

separating the first outer ply and the middle ply from the second outer ply in the unwound portion of the treated multi-ply web;

threading the first outer ply and the middle ply around a periphery of the roll; and bringing the first outer ply and middle ply into contact with the second outer ply of the treated multi-ply web to form the reoriented multi-ply web.

40. The method of claim 34 wherein the resting comprises applying a chemical to one or both of the exposed dryer sides.

41. The method of claim 40 wherein the treating comprises printing a virucidal solution to one or both of the exposed dryer sides.

42. The method of claim 41 wherein the treating comprises printing an ink to one or both of the exposed dryer sides.

43. A method comprising the steps of:

providing at least two plies paper each ply having a first and a second opposing surface;

combining the at least two plies paper together to form a multi-ply web;

winding the multi-ply web into a roll on a first converting machine;

transporting the roll to another location for treatment;

unwinding the multi-ply web on a second converting machine, treating either the first or the second opposing surface of the multi-ply web forming a treated multi-ply web, and winding the treated multi-ply web into a second roll;

transporting the second roll to another location;

changing the location of the treated surface within the multi-ply web forming a reoriented multi-ply web; and threading a third converting machine with the reoriented multi-ply web.

44. The method of claim 43 wherein the first, second, and third converting machines are all located within one manufacturing facility.

45. The method of claim 43 wherein at least one of the first, second, or third converting machines is located in another manufacturing facility.

46. The method of claim 43 wherein the first and the third converting machines are located at one manufacturing facility and the second converting machine is located at another manufacturing facility.

47. The method of claim 43 wherein changing the location of the treated surface comprises dropping a ply.

48. The method of claim 43 wherein changing the location of the treated surface comprises:

unwinding a portion of the treated multi-ply web from the roll;

separating at least one ply from the unwound portion of the treated multi-ply web;

threading the separated at least one ply around a periphery of the roll; and bringing the separated at least one ply into contact with the remaining unwound portion of the treated multi-ply web to form the reoriented multi-ply web.

* * * * *